US007237384B2

(12) United States Patent
Stuttaford et al.

(10) Patent No.: US 7,237,384 B2
(45) Date of Patent: Jul. 3, 2007

(54) COUNTER SWIRL SHEAR MIXER

(76) Inventors: Peter Stuttaford, 12075 159th Court North, Jupiter, FL (US) 33478; Yan Chen, 612 Moondancer Ct., Palm Beach Gardens, FL (US) 33410

( * ) Notice: Subject to any disclaimer, the term of this patent is extended or adjusted under 35 U.S.C. 154(b) by 193 days.

(21) Appl. No.: 10/905,907

(22) Filed: Jan. 26, 2005

(65) Prior Publication Data

US 2006/0162337 A1 Jul. 27, 2006

(51) Int. Cl.
*F23R 3/12* (2006.01)

(52) U.S. Cl. ..... 60/776; 60/737; 60/760

(58) Field of Classification Search ..... 60/733, 60/737, 738, 740, 760, 776
See application file for complete search history.

(56) References Cited

U.S. PATENT DOCUMENTS 5,165,241 A 11/1992 Joshi et al.
5,515,680 A 5/1996 Fujimura et al.
6,209,325 B1 * 4/2001 Alkabie ..... 60/737
6,609,376 B2 * 8/2003 Rokke ..... 60/748
2004/0226300 A1 * 11/2004 Stuttaford et al. ..... 60/737
2005/0016177 A1 * 1/2005 Modi et al. ..... 60/737

* cited by examiner

*Primary Examiner*—L. J. Casaregola

(57) ABSTRACT

The present invention provides a mixer for a gas turbine combustor comprising a plurality of generally annular walls interconnected by at least a plurality of first vanes. The vanes are oriented at angles, so as to create a shear layer between the two flows. A fuel is then injected so as to penetrate the shear layer for enhanced mixing. The mixture passes through an extended mixing passage to provide sufficient time and distance for improved mixedness prior to ignition. Multiple embodiments of the present invention are disclosed comprising a plurality of first vanes and a plurality of first and second vanes.

13 Claims, 7 Drawing Sheets

FIGURE 1 - PRIOR ART

FIGURE 2 - PRIOR ART

Mass Fraction of CH4

Unmixedness

COUNTER SWIRL SHEAR MIXER

BACKGROUND OF THE PRIOR ART

The present invention relates generally to gas turbine combustors and more specifically to a fuel and air mixing device in a gas turbine combustor.

In a gas turbine engine, the combustion section contains a reaction that occurs when fuel and compressed air are mixed together and react after being ignited by an ignition source. Compressed air is directed to one or more combustion chambers from the engine compressor. Fuel injection devices inject a fuel, either liquid or gas, into the compressed air stream and the mixture undergoes a chemical reaction once being exposed to a heat source, such as an igniter.

Some examples of prior art mixer devices are shown in FIGS. 1 and 2. FIG. 1 is a cross section of a combustion system disclosed in U.S. Pat. No. 5,515,680, and hereby incorporated by reference. The combustion system utilizes a ring member 31 to inject a fuel transverse to the flow direction of the premixing combustion air, at the outside of a 180 degree bend in the air flow path, in an effort to inject the fuel from a high velocity region towards a lower velocity region for improved mixing. While this technique may improve mixing locally, further improvements can be made such that additional time and distance is provided in the region upstream of the combustor to further enhance premixing. FIG. 2, on the other hand, is a cross section of a fuel injector and mixing device disclosed in U.S. Pat. No. 5,165,241 that injects a fuel from the centerbody of the injector, radially outward into the passing air stream, which has previously undergone counter rotating swirl from inner swirler 26 and outer swirler 28. While this type of mixer attempts to provide improved premixing, it too can be improved by providing a longer time and distance for the fuel and air premixing to be more complete prior to ignition.

In order to control emissions levels of oxides of nitrogen (NOx) and carbon monoxide (CO), it is critical that the fuel molecules burn as completely as possible such as to not leave any unburned hydrocarbons to pass into the atmosphere. In order for the fuel to completely burn a number of issues must be addressed, one of which is fuel and air mixedness prior to ignition. Fuel and air mixedness is controlled by factors such as swirl, fuel injection location, and mixing time prior to ignition. Therefore, for the lowest possible emissions, it is most desirable to provide a mixer for a gas turbine combustor that optimizes swirl, fuel injection location, and mixing time such that the combustion process will be as complete as possible.

SUMMARY AND OBJECTS OF THE INVENTION

The present invention provides a mixer for a gas turbine combustor wherein the mixer comprises a plurality of annular walls containing at least a plurality of first vanes oriented at a first angle in between said annular walls, thereby creating a shear layer. A fuel injector is positioned adjacent the vanes to inject a fuel such that the fuel jet penetrates the shear layer for optimum mixing. Furthermore, the annular walls of the mixer are configured such that sufficient time and distance is provided in order to obtain optimum mixing prior to ignition of the fuel/air mixture.

DETAILED DESCRIPTION OF THE PREFERRED EMBODIMENT

Figure 1:
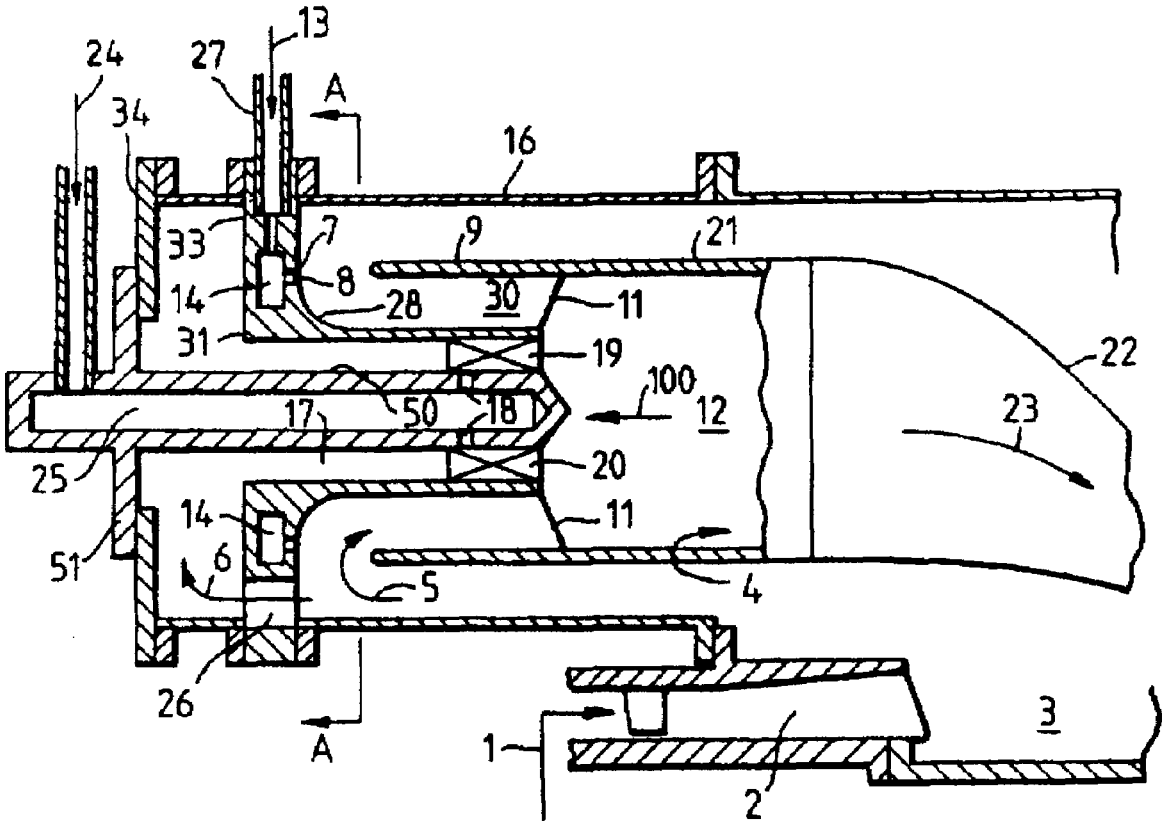
FIG. 1 is a cross section of a gas turbine combustor and mixer of the prior art.
Figure 2:
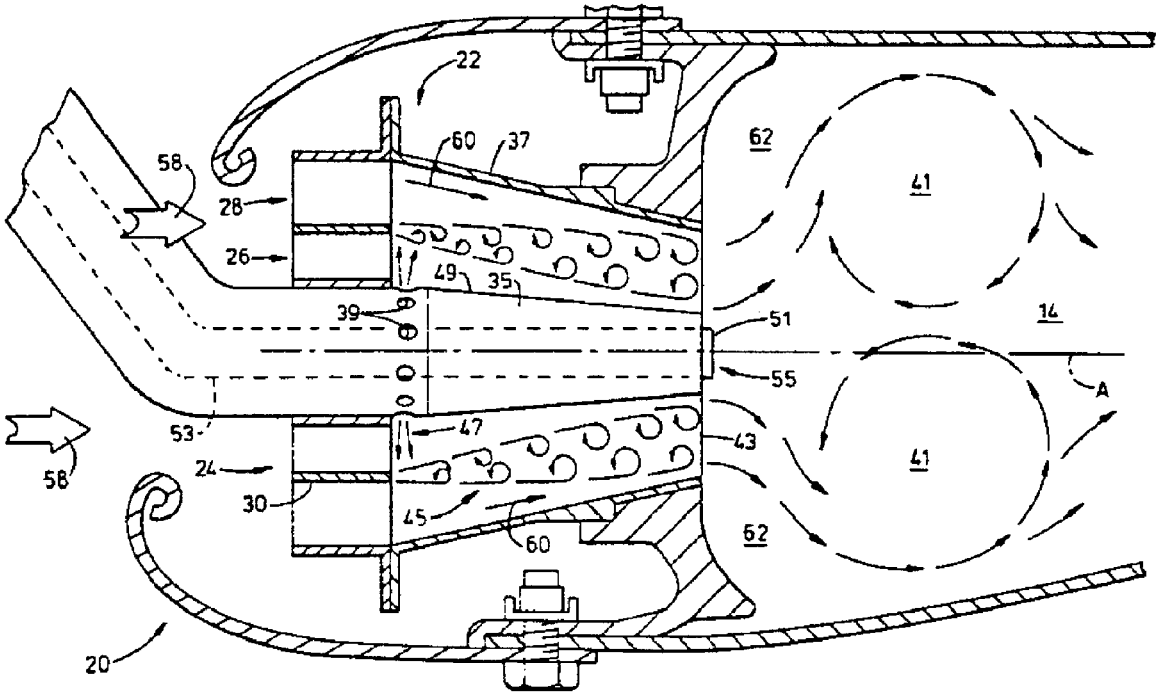
FIG. 2 is a detailed cross section view of another mixing device of the prior art.
Figure 3:
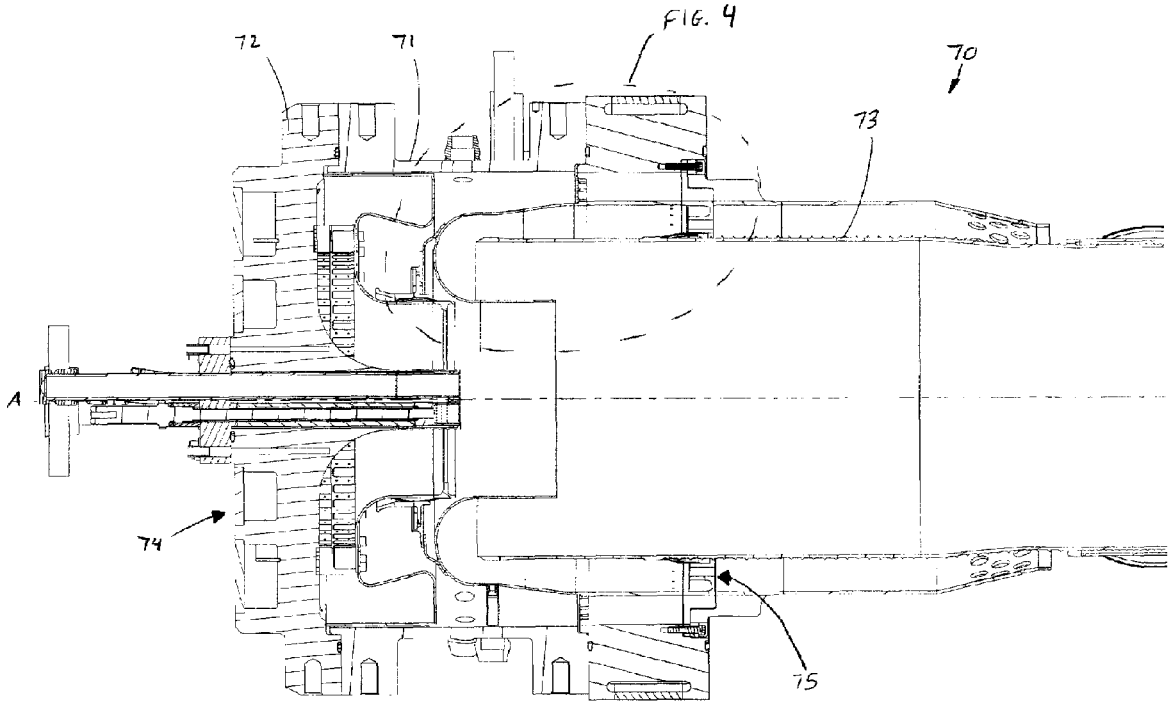
FIG. 3 is a cross section of a gas turbine combustor incorporating a mixer in accordance with the preferred embodiment of the present invention.

The preferred embodiment of the present invention will now be described in detail with particular reference made to FIGS. 3-7. Referring now to FIG. 3, gas turbine combustor 70 is shown in cross section. The present invention pertains to a mixer for combustor 70. In the preferred embodiment of the present invention, combustor 70 comprises a casing 71, end cover 72, combustion liner 73, and a pilot injector 74. Another feature of combustor 70 is mixer 75, which is shown in greater detail in a detailed cross section in FIG. 4.

Figure 4:
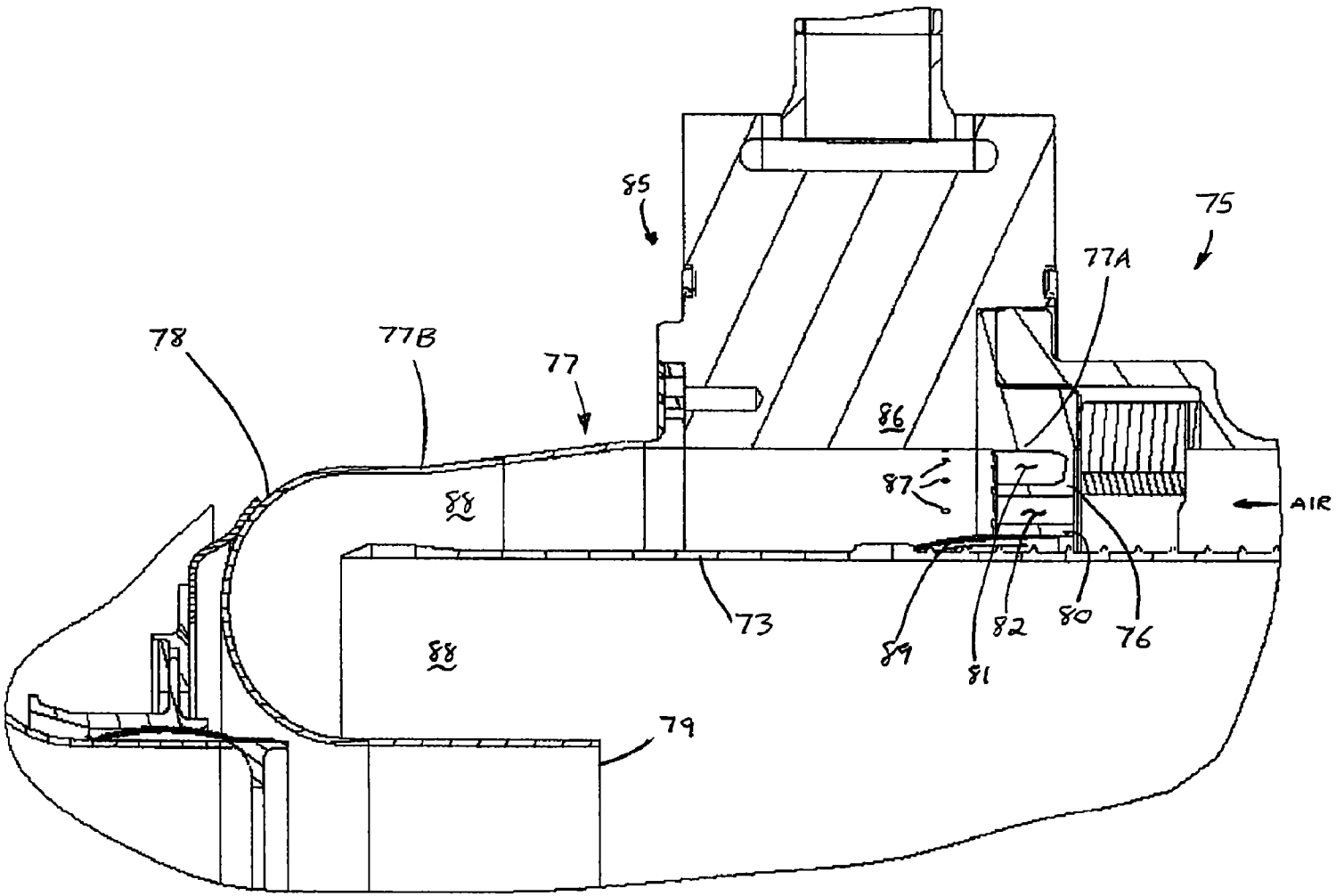
FIG. 4 is a detailed cross section of a portion of the mixer in accordance with the preferred embodiment of the present invention.
Figure 5:
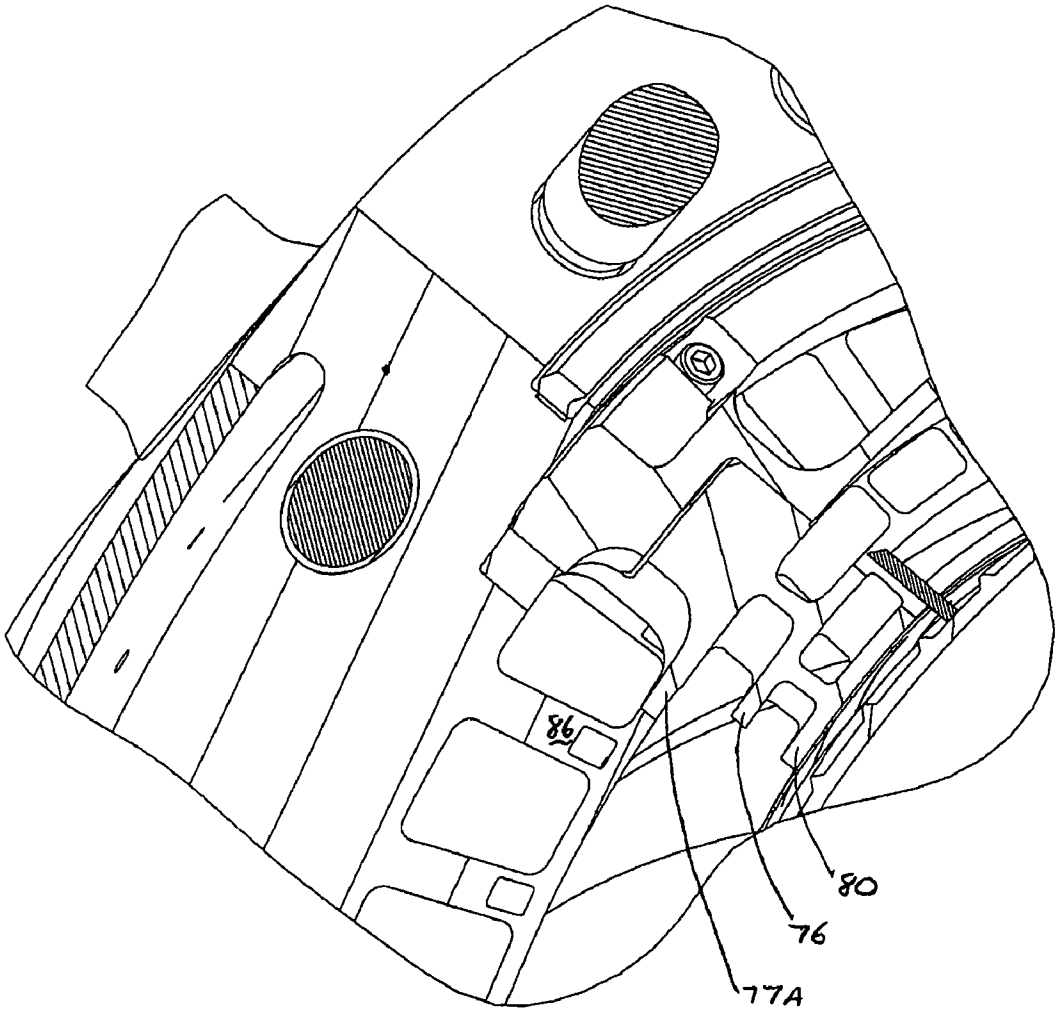
FIG. 5 is a partial perspective view of a portion of the mixer in accordance with the preferred embodiment of the present invention.
Figure 6:
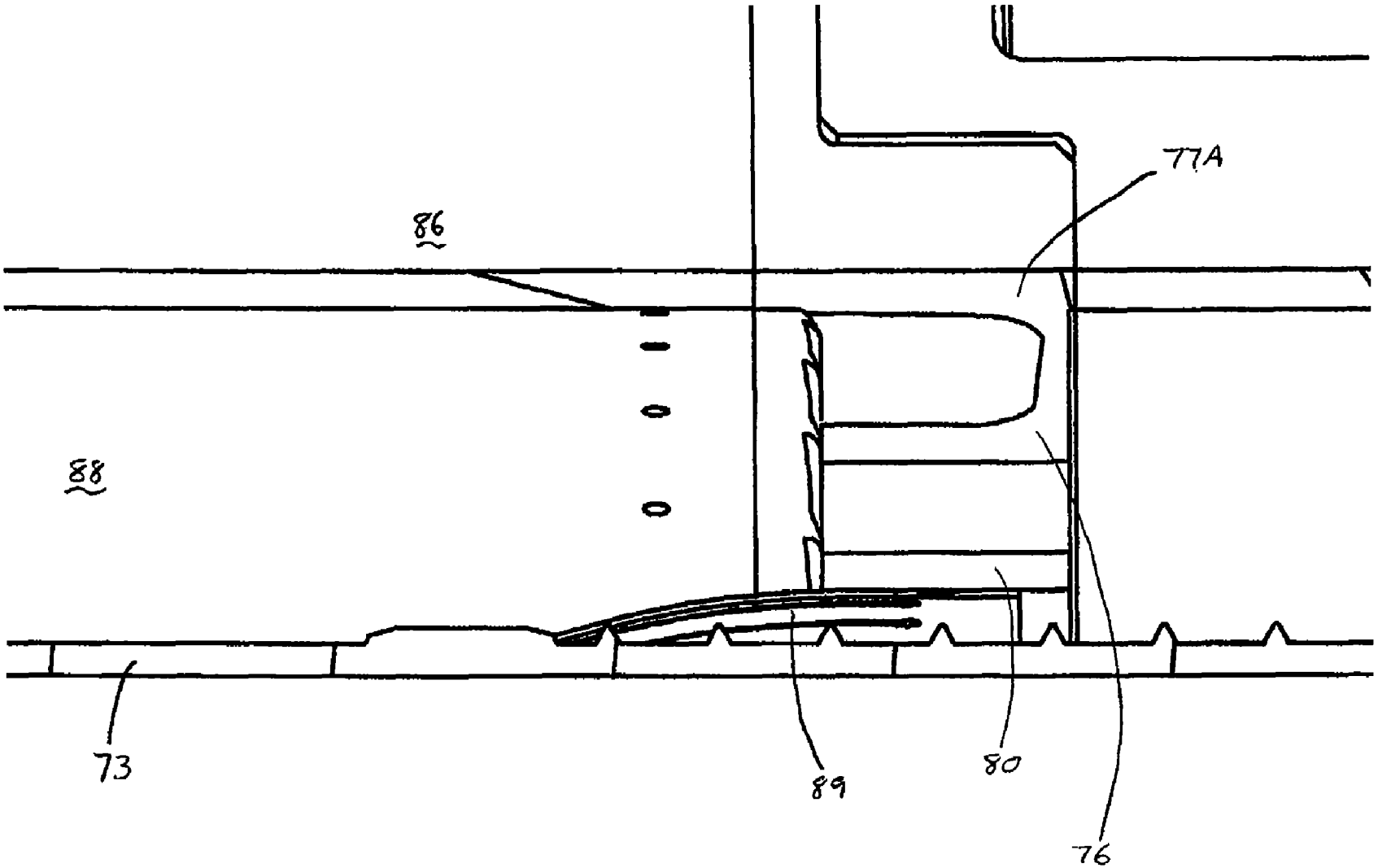
FIG. 6 is an additional detailed cross section of a portion of the mixer in accordance with the preferred embodiment of the present invention.
Figure 7:
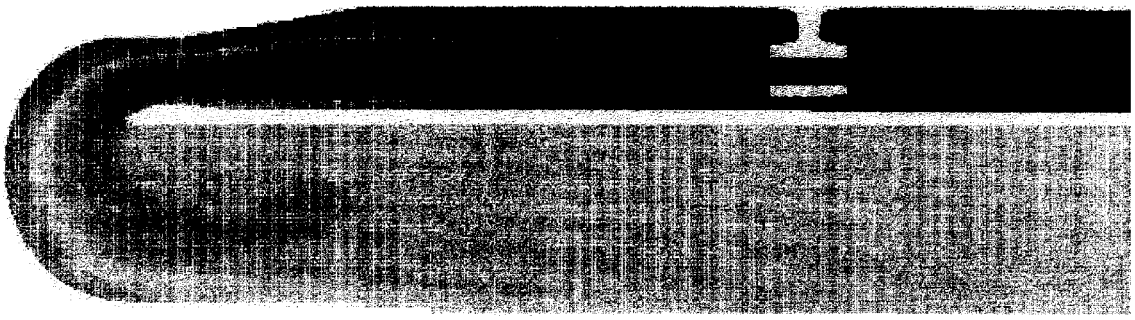
FIG. 7 is a plot showing analysis results of percent of fuel that is unmixed at various locations throughout the mixer of the present invention.

Mixer 75, which serves to provide a region for thorough fuel and air mixing prior to ignition, comprises multiple components depending on the desired level of fuel and air mixedness. For a complete understanding of the invention, all components of mixer 75 are shown in FIGS. 4-6. Mixer 75 comprises a first generally annular wall 76 that is located coaxial with a combustor center axis A-A (see FIG. 3). Located radially outward of and coaxial with first generally annular wall 76 is a second generally annular wall 77 having a first portion 77A and a second portion 77B having a bend 78 such that a first end 79 of second generally annular wall 77 is located radially inward of first generally annular wall 76 and axially within combustion liner 73. A third generally annular wall 80 is located radially inward of and coaxial with first generally annular wall 76. Extending between first generally annular wall 76 and first portion 77A of second generally annular wall 77 is a plurality of first vanes 81 that are oriented at a first angle relative to centerline A-A. A plurality of second vanes 82 extend between first generally annular wall 76 and third generally annular wall 80. Second vanes 82 are oriented at a second angle relative to the first angle so as to create a shear layer adjacent first generally annular wall 76. Depending on the desired swirl level and resulting mixing, the quantity and angles of first vanes 81 and second vanes 82 can vary. For the preferred embodiment, the shear layer resulting from first vanes 81 and second vanes 82 is formed by a difference between the first angle and second angle of between 20 and 60 degrees.

An additional feature of mixer 75 is fuel injector 85, which is located adjacent second generally annular wall 77 for injecting a fuel into the shear layer formed adjacent first generally annular wall 76. In the preferred embodiment of the present invention, fuel injector 85 comprises an annular manifold 86 having a plurality of injection locations 87 around annular manifold 86. Furthermore, injection locations 87 are oriented generally perpendicular to center axis A-A.

As a result of the radial and axial positions of the generally annular walls 76, 77, and 80 as well as position of combustion liner 73, a mixing passage 88 is created. Mixing passage 88 is formed between second generally annular wall 77 and combustion liner 73 and serves as a region of extended length for mixing fuel and air, due to bend 78 in second portion 77B of second generally annular wall 77.

An additional feature of mixer 75 is its ability to compensate for thermal expansion of combustion liner 73. Combustion liner 73 contains a spring seal 89 that is fixed to the outer surface of combustion liner 73 at a first seal end and is free at a second seal end. The third generally annular wall 80 of mixer 75 engages spring seal 89 proximate its second seal end to provide a means for maintaining the dimensions of mixing passage 88 that is compliant to various thermal changes between combustion liner 73 and mixer 75.

In operation, having provided the aforementioned combustor and mixer geometry, a flow of air is provided to mixer 75. The airflow is then split with a first portion of air being directed through first vanes 81 and a second portion being directed through second vanes 82. The airflow portions are swirlered at their respective angles by their respective vanes and form a shear layer, or more specifically, a layer of air in between two rotating flows of different degrees. This shear layer has a thickness, which is attributed to the thickness of first generally annular wall 76 directly upstream of the shear layer. Fuel is then injected into the shear layer to form a premixture in mixing passage 88. The premixture is directed through bend 78 and into the combustor for ignition.

As a result of the swirl vane configuration and orientation, the fuel injection from a manifold configuration into the shear layer, coupled with the mixing passage distance and time, computational analysis has predicted an extremely high rate of mixedness prior to ignition. A plot of this analysis can be seen in FIG. 7 and shows a cross section of mixer 75 with fluid flowing through the mixer. The dark regions adjacent the swirl vanes represent the air while adjacent the swirlers a jet penetrating the swirling air flow is positioned injecting a fuel generally perpendicular to the center axis. As the premixture travels through mixing passage 88 and towards bend 78, approximately 14.2% of the fuel molecules have not mixed with air, and if ignition occurred at this location, significant emissions would result. The rate of unmixedness at this location is common to combustors having similar generally axial premixing passages prior to ignition. However, due to bend 78 in mixing passage 88, and the additional passage length as a result, further mixing occurs. Analysis of unmixed fuel particles at the exit of bend 78, proximate the entrance to combustion liner 73, shows only 1.94% of fuel molecules are unmixed. The result of this unmixedness level is even lower emissions. These predictions of unmixedness have been verified by extensive rig testing. Depending on desired performance and emissions, fuel injection hole sizes and position would vary such that the resulting fuel jet penetrates the shear layer as desired. For the present invention, it is preferred to have only one row of fuel injectors 87 circumferentially about annular manifold 86.

In a first alternate embodiment of the present invention, mixer 85 contains only plurality of first vanes 81 between first generally annular wall 76 and second generally annular wall 77. In this embodiment, the shear layer is formed between the angle of first vanes 81 and the flow passing through a passageway formed by first generally annular wall 76 and combustion liner 73. While this configuration is simpler to manufacturer and can be manufactured at a lower cost due to the simplified geometry, the mixing benefits associated with the shear layer are not as great given the limited shear generated by the interaction from a single set of vanes and an axial flow. This first alternate embodiment is advantageous if radial space for mixing is limited or sufficient mixing can be achieved with a single set of vanes.

A second alternate embodiment maintains the benefits of the preferred embodiment with respect to the shear generated by opposing flow angles from the plurality of first and second vanes, but eliminates seal 89. Removing seal 89 from the mixer geometry simplifies the manufacturing and reduces the associated cost by eliminating a component that is manufactured from a higher cost alloy having spring capability. However, while removing seal 89 simplifies the manufacturing process and can reduce cost, it does allow for additional thermal movement between combustion liner 73 and mixer 75 than if seal 89 were present, thereby affecting dimensions of mixing passage 88. Depending on the operating conditions and temperatures of combustor 70, eliminating seal 89 may not have adverse affects on fuel and air mixing and combustor performance.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What is claimed is:

1. A mixer for a gas turbine combustor comprising:

A first generally annular wall located coaxial with a center axis;

A second generally annular wall having a first portion located radailly outward of and coaxial with said first generally annular wall, and a second portion having a bend such that a first end of said second generally annular wall is located radially inward of said first generally annular wall and axially within a combustion liner;

A plurality of first vanes extending between said first generally annular wall and said first portion of said second generally annular wall, said first vanes oriented at a first angle so as to create a shear layer adjacent said first generally annular wall; and, A fuel injector located adjacent said second generally annular wall for injecting a fuel into said shear layer formed adjacent said first generally annular wall.

2. The mixer of claim 1 further comprising a passageway between said first annular wall and said combustion liner.

3. The mixer of claim 1 wherein said first angle is between 20 and 60 degrees.

4. The mixer of claim 1 wherein said fuel injector comprises an annular manifold having a plurality of injection locations around said annular manifold.

5. The mixer of claim 4 wherein said plurality of injection locations is oriented generally perpendicular to said center axis.

6. The mixer of claim 1 wherein a mixing passage is formed between said second generally annular wall and said combustion liner.

7. The mixer of claim 1 further comprising a third generally annular wall located radially inward of and coaxial with said first generally annular wall.

8. The mixer of claim 7 further comprising a plurality of second vanes extending between said first generally annular wall and said third generally annular wall, said second vanes oriented at a second angle relative to said first angle so as to create a shear layer adjacent said first generally annular wall.

9. The mixer of claim 8 wherein said third generally annular wall is in contact with a flexible seal.

10. The mixer of claim 8 wherein the difference between said first angle and said second angle is between 20 and 60 degrees.

11. A method of enhancing the mixing of fuel and air in a combustor comprising the steps:

Providing a mixer comprising:

A first generally annular wall located coaxial with a center axis;

A second generally annular wall having a first portion located radailly outward of and coaxial with said first generally annular wall, and a second portion having a bend such that a first end of said second generally annular wall is located radially inward of said first generally annular wall and axially within a combustion liner;

A plurality of first vanes extending between said first generally annular wall and said first portion of said second generally annular wall, said first vanes oriented at a first angle so as to create a shear layer adjacent said first generally annular wall; and, A fuel injector located adjacent said second generally annular wall for injecting a fuel into said shear layer formed adjacent said first generally annular wall;

Providing a flow of air to said mixer;

Directing a first portion of said air through said first vanes;

Directing a second portion of said air through a passageway between said first generally annular wall and a combustion liner;

Injecting a fuel into said shear layer to form a premixture; and,

Directing said premixture through said mixing passage, said bend, and into said combustion liner.

12. The method of claim 11 further comprising the step of providing a third generally annular wall located radially inward of and coaxial with said first generally annular wall.

13. The method of claim 12 further comprising the step of providing a plurality of second vanes extending between said first generally annular wall and said third generally annular wall, said second vanes oriented at a second angle relative to said first angle so as to create a shear layer adjacent said first generally annular wall.

* * * * *